US009450322B2

(12) United States Patent
Ljubijankic

(10) Patent No.: US 9,450,322 B2
(45) Date of Patent: Sep. 20, 2016

(54) ELECTRICAL CONTACT HAVING TINES WITH EDGES OF DIFFERENT LENGTHS

(71) Applicant: AMPHENOL CORPORATION, Wallingford, CT (US)

(72) Inventor: Zlatan Ljubijankic, Mississauga (CA)

(73) Assignee: AMPHENOL CORPORATION, Wallingford, CT (US)

( * ) Notice: Subject to any disclaimer, the term of this patent is extended or adjusted under 35 U.S.C. 154(b) by 0 days.

(21) Appl. No.: 14/599,262

(22) Filed: Jan. 16, 2015

(65) Prior Publication Data

US 2016/0211600 A1 Jul. 21, 2016

(51) Int. Cl.
*H01R 13/11* (2006.01)
*H01R 43/16* (2006.01)

(52) U.S. Cl.
CPC ..... *H01R 13/112* (2013.01); *H01R 43/16* (2013.01)

(58) Field of Classification Search
CPC ..... H01R 13/112; H01R 43/16
USPC ..... 439/842, 861, 884, 924.1, 851
See application file for complete search history.

(56) References Cited

U.S. PATENT DOCUMENTS 3,862,792 A * 1/1975 Jayne ..... H01R 13/111 439/733.1
4,272,149 A 6/1981 Gallusser et al.
4,566,752 A 1/1986 Hemmer
4,591,230 A * 5/1986 Roldan ..... H01R 13/112 439/856
4,810,214 A * 3/1989 Yohn ..... H01R 13/426 29/874
5,004,426 A * 4/1991 Barnett ..... H01R 12/585 439/82
5,088,942 A 2/1992 Welsh et al.
5,108,304 A * 4/1992 Bogiel ..... H01R 13/28 439/287
5,135,418 A * 8/1992 Hatagishi ..... H01R 13/111 439/851
5,458,513 A 10/1995 Matsuoka
5,556,292 A * 9/1996 Kato ..... H01R 24/40 439/218
5,628,656 A * 5/1997 Macioce ..... H01R 13/052 439/851
5,938,487 A 8/1999 Henry et al.
6,186,841 B1 2/2001 Jacobsson
6,250,974 B1 6/2001 Kerek
6,955,569 B2 10/2005 Baker et al.
7,845,992 B2 * 12/2010 Glick ..... H01R 4/185 439/843
8,257,120 B2 * 9/2012 Shimizu ..... H01R 13/111 439/851
8,632,356 B2 * 1/2014 Bihrer ..... H01R 13/18 439/442
8,782,883 B2 * 7/2014 Shimizu ..... H01R 13/111 29/874
8,821,196 B2 9/2014 Blasick et al.
2004/0242085 A1 12/2004 Coulon
2013/0225015 A1 * 8/2013 Blasick ..... H01R 13/111 439/842

FOREIGN PATENT DOCUMENTS

KR 102005005491 A 6/2005

* cited by examiner

*Primary Examiner* — Tulsidas C Patel
*Assistant Examiner* — Peter G Leigh
(74) *Attorney, Agent, or Firm* — Blank Rome LLP

(57) ABSTRACT

The present invention relates to electrical contacts having tines with uneven edges to provide increased contact normal force and decreased peak stress. The socket electrical contact contains a socket body that includes a base defining a longitudinal axis and tines extending from the base at spaced-apart locations around the circumference of the base. The tines extend from the base in the direction of the axis to define a pin reception zone between the tines. Each tine contains two opposing edges that have different lengths and a blunt tip.

20 Claims, 5 Drawing Sheets

ELECTRICAL CONTACT HAVING TINES WITH EDGES OF DIFFERENT LENGTHS

FIELD OF THE INVENTION

The present invention relates to electrical contacts having tines with uneven edges to provide increased contact normal force and decreased peak stress.

BACKGROUND OF THE INVENTION

A socket contact is designed for mating with a pin contact of an electrical device. A socket contact generally includes a socket that receives the mating pin therein. When the mating pin is received within the socket, tines (also referred to as contact beams) of the socket contact engage the mating pin to establish an electrical connection between the socket contact and the mating pin. Socket contacts generally have a body with a tubular base and tines which extend from the base at circumferentially spaced-apart locations around the base. The tines are designed for mating engagement with a pin contact which is inserted along an axis between the tines. These socket contacts may be made by stamping and forming, drawing, or screw machine methods, but in most cases, material is removed from the body to define the spaced-apart tines. The tines are generally of the same length and designed to grip the pin that is inserted into the socket contact.

There is a need for electrical socket contacts that allows for improved contact normal force and peak stress.

SUMMARY OF THE INVENTION

The present invention relates to socket electrical contacts containing a socket body that includes a base defining a longitudinal axis and tines extending from the base at spaced-apart locations around the circumference of the base. The tines extend from the base in the direction of the axis to define a pin reception zone between the tines. Each tine contains two opposing edges that have different lengths and a blunt tip. The present socket contact design provides improved contact normal force and decreased peak stress when compared to a design without a taper tip (both edges of each tine having the same length).

The present invention also relates to methods for making and using the socket electrical contact.

BRIEF DESCRIPTION OF THE DRAWINGS

The foregoing background and summary, as well as the following detailed description of the drawings, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

DETAILED DESCRIPTION OF THE PREFERRED EMBODIMENTS

Figure 1:
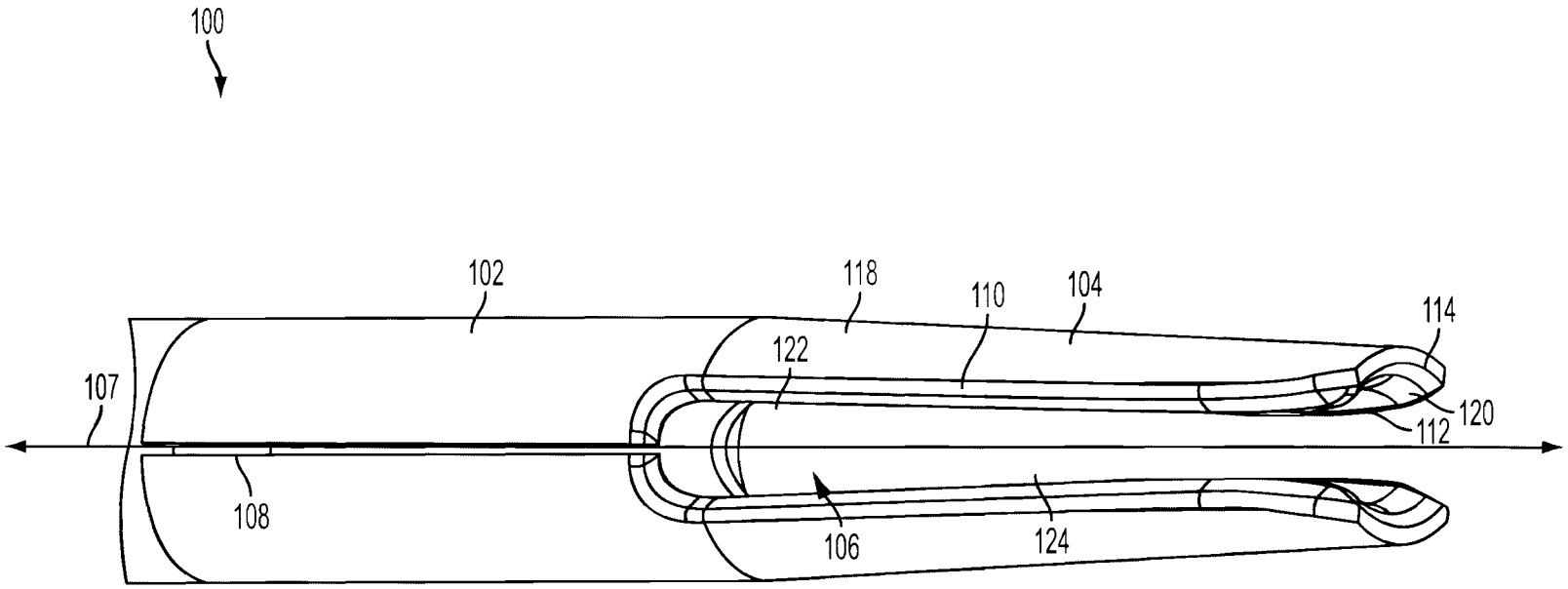
FIG. 1 shows a three dimensional view of an embodiment of the present invention.
Figure 2:
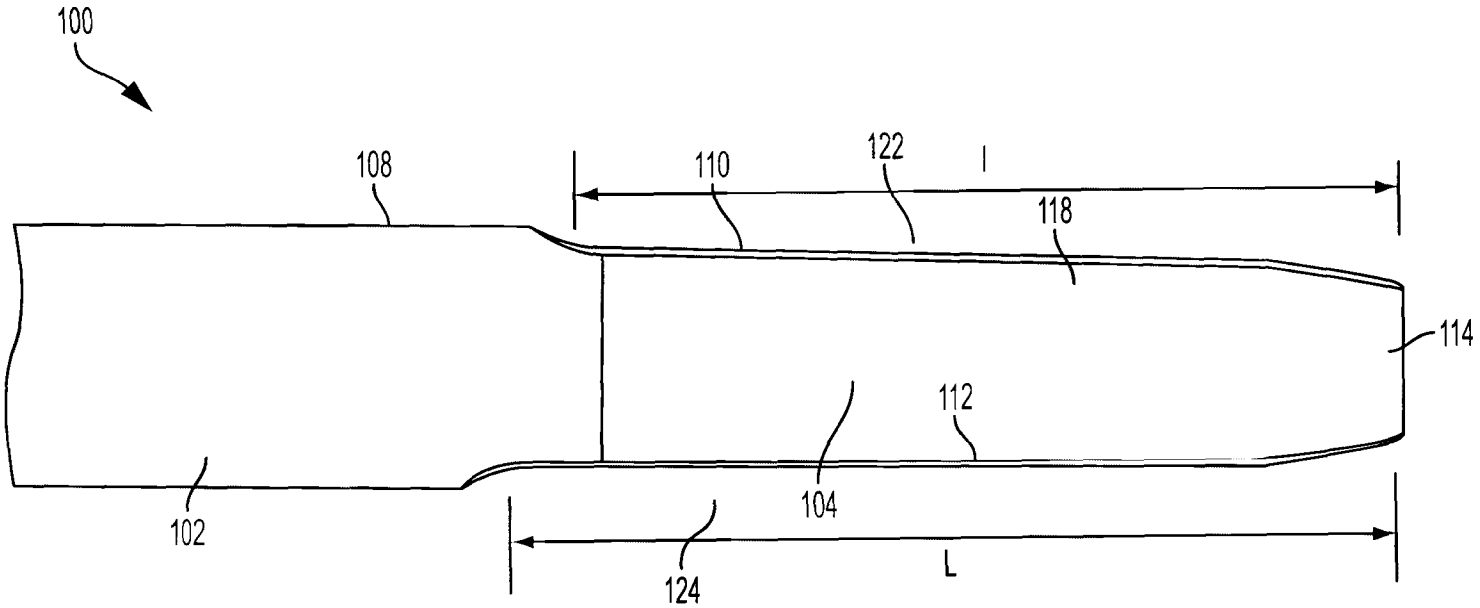
FIG. 2 shows an outside side view of a tine of the present invention.
Figure 3:
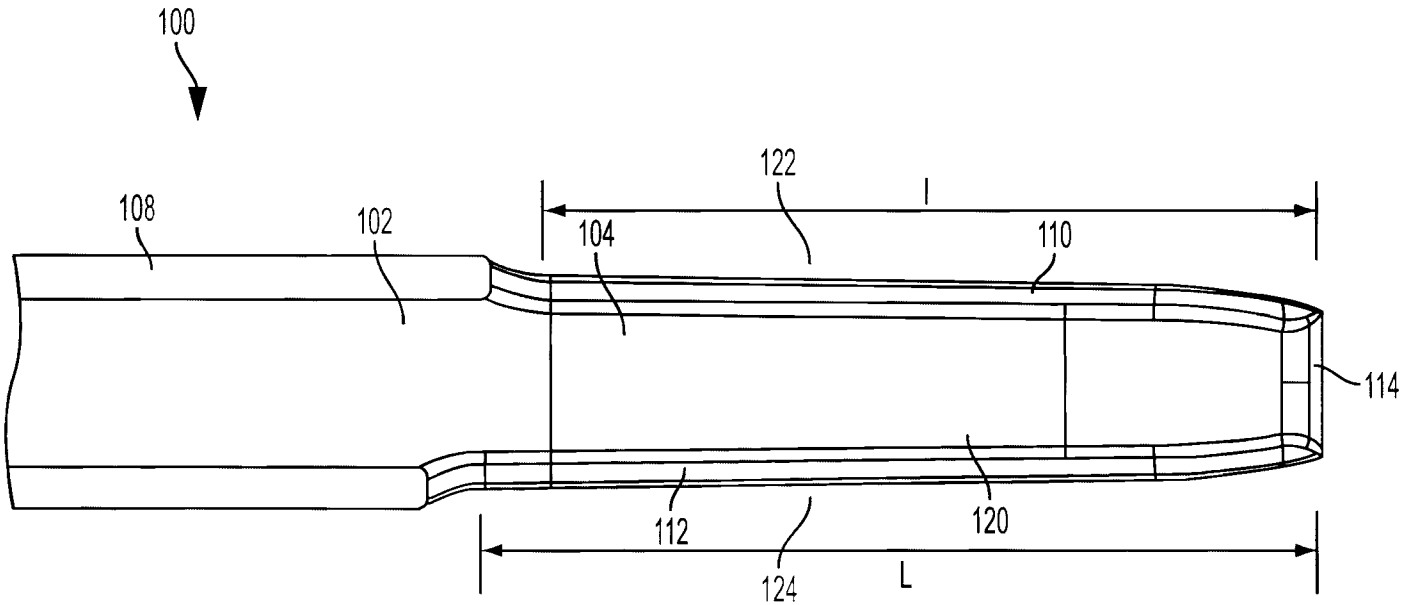
FIG. 3 shows a cut away, inside side view of a tine of the present invention.

The present invention relates to socket electrical contacts having at least one tine with uneven edges to provide increased contact normal force and decreased peak stress. Referring to FIGS. 1-3, where like reference numerals refer to like elements, the socket contact contains a body 100 which includes a base 102 defining a longitudinal axis and tines 104 extending from the base 102 at spaced-apart locations around the circumference of the base 102. The tines 104 extend from the base 102 in the direction of the axis to define a pin reception zone 106 between the tines 104.

The body 100 is generally tubular in shape. The tubular shape may have an elliptical, circular, or parallelogram (such as triangle, square, pentagon, hexagon, octagon, etc.) cross-section. Although shown with the exemplary cylindrical shape, the body 100 of the socket contact may additionally or alternatively include any other shape(s). Moreover, the socket contact is not limited to being used with a cylindrical mating pin. Rather, the socket and mating zone of the socket contact may be configured to mate with a mating pin that includes any other shape(s) in addition or alternatively to the cylindrical shape. The body 100 extends a length along a central longitudinal axis 107. The body 100 includes a base 102 and tines 104 that extend from the base 102. Although the present figures shows a socket contact containing two tines 104, the socket contacts in accordance with the present invention may contain more than two tines extending from the base at spaced-apart locations around the circumference of the base 102. The socket contact may contain 2, 3, 4, 5, or more tines, although the preferred embodiment contains two tines. The tines 104 may deflect slightly away from or toward the central axis 107 to allow for cantilever deflection to the tines 104 when they are mated to a pin. The body 100, because it is usually cut and shaped from a single sheet of conductive material, preferably contains a seam 108 in the base 102, which extends in the direction approximately parallel to the central axis 107.

Each tine 104 contains an exterior surface 118, a contact surface 120, and two opposing edges 110 and 112. The two opposing edges have different lengths and form a blunt tip 114. The bunt tip is form by a line connecting the short edge 110 to the long edge 112 and is approximately perpendicular to the length axis of the tine 104. Both edges 110 and 112 extend from the base 102 to the tip 114. The long edge 112, as illustrated in FIGS. 2-3, has a length L; and the short edge 110 has a length l. The short edge 110 is preferably about 5-12% shorter than the long edge 112, more preferably about 7-10% shorter. In an embodiment, on each tine 104, the short edge 110 is preferably closer to the seam 108 than the long edge 112. Because of the edges 110 and 112 on each tine 104 have different lengths, l and L respectively, the slots 122 and 124 formed between the tines also have different lengths. As illustrated in FIGS. 1-3, the slot 122 formed between the short edges 110 of adjacent tines are shorter than the slot 124 formed between the long edges 112 of adjacent tines. In a preferred embodiment, where the short edge 110 is closer to the seam 108, the slot 122, which is closer to the seam 108, has a shorter length than the slot 124, which is farther away from the seam 108.

The body 100 of the socket contact may be fabricated from any material(s) that enable the body 100 to be electrically conductive. The body 100 of the socket contact may be fabricated using any method, process, structure, means, and/or the like, such as, but not limited to, using a cutting process, using a casting process, using a molding process, using a forming process, and/or the like. Cutting processes include, but are not limited to, water cutting, stamping, laser cutting, punching, cutting using a saw, drill bit, plane, mill, and/or other solid cutting tool, and/or the like. Forming processes include, but are not limited to, drawing, bending, and/or the like. When the body 100 is fabricated using a cutting process, the body 100 of the socket contact may be cut from a reel of material, from a blank of material, from an approximately flat sheet of material, from an approximately flat material, from a rod of material, and/or the like.

In some embodiments, the body 100 of the socket contact is a cut and formed from a material and then formed to include the shape (e.g., the exemplary tubular shape) of the body 100. For example, various cuts may be made to the material to define the body 14 of the socket contact 10 from the material. Examples of such cuts include cutting an initial shape of the base 102, and/or the tines 104 (e.g., cutting slots to separate adjacent tines from each other and to partially define the shapes of the tines). Other features of the socket contact that may also be cut from the material. Once the material has been cut, the material may be formed to define the finished shapes of the base 102 and the tines 104, and/or other features of the socket contact. For example, the body 100 may be formed to include the exemplary tubular shape shown herein, which may provide the tines 104 with the curved contact surfaces 120. Moreover, for example, the tines 104 may be bent to converge to the central longitudinal axis 107. When cut and formed to include the exemplary tubular shape shown herein, the finished shape of the body 100 may include the seam 108. Cut and formed contacts may be less expensive to fabricate than machined contacts. In some embodiments, the body 100 may be a cut and drawn body that is cut from a material and then drawn to form the finished shape of the body 100. The body 100 of the socket contact is a stamped and formed body that is stamped from a material and then formed to include the finished shape of the body 100 in some embodiments. In a preferred embodiment, the socket contacts are cut from a sheet of conductive material, then formed into its three dimensional shape by various dies.

In use, electrical contact, e.g. between two electrical devices, is made when the socket contact is mated to a pin contact. Here, the pin contact is inserted along an axis between the tines 104. The interior surfaces 120 of the tines 104 contact and engage the pin contact forming an electrical connection.

Without further description, it is believed that one of ordinary skill in the art can, using the preceding description and the following illustrative example, make and utilize the device of the present invention and practice the claimed methods. The following example is given to illustrate the present invention. It should be understood that the invention is not to be limited to the specific conditions or details described in this example.

Example

Figure 4A:
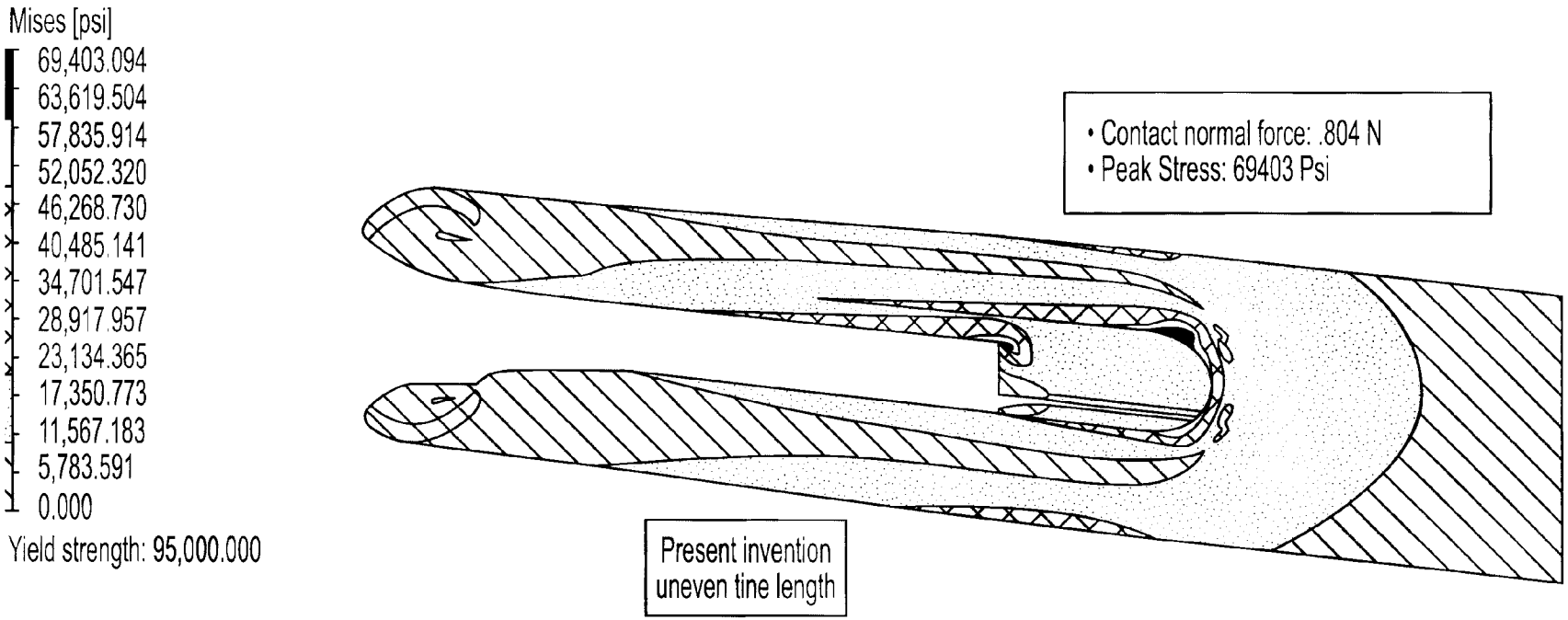
FIGS. 4A and 4B show a comparison of the present invention with a socket contact with tines having even edges.
Figure 4B:
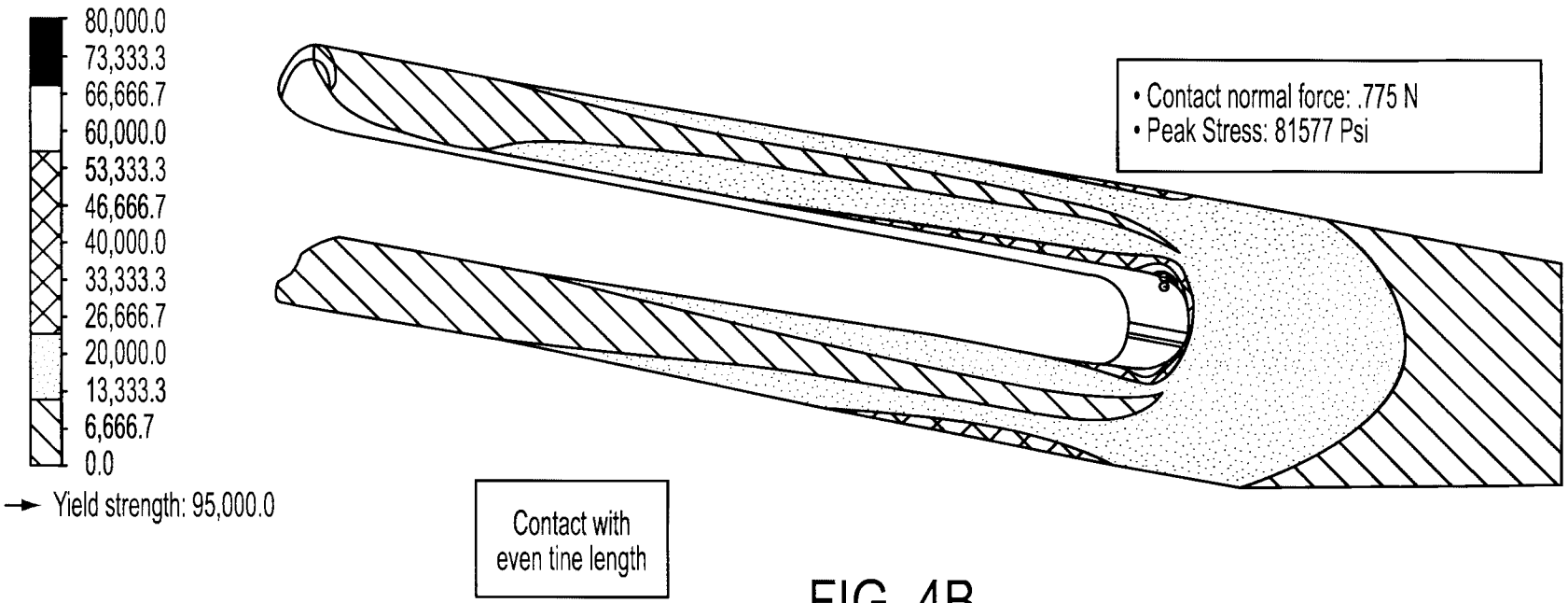

A socket contact having two tines with taper tips was made in accordance with the present invention This socket contact had a two tines as shown in FIG. 4 and had the following dimensions: short edge: 0.157 in., long edge: 0.169 in., tine width: 0.380 in., slot width: 0.17 in., base diameter 0.049 in. A similar contact having tines with edges of the same length was provided to compare with the socket contact of the present invention. All dimensions of this contact were the same as the one with uneven tines, except that the edges of the tines have the same length of 0.0163 in. Contact normal forces and peak stresses were determined for the two socket contacts using SoldWorks FEA analysis software.

FIG. 4 shows that the socket contact that was made in accordance with the present invention provided 4% increase in contact normal force and 17% decrease in peak stress, when mated to a pin contact.

Although certain presently preferred embodiments of the invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A socket electrical contact comprising a body having
a. a base; and
b. at least two tines extending from the base, each tine containing two opposing edges, a contact surface, and an exterior surface, and each of the edges of each tine defining a length from the base to a tip of each tine, respectively, wherein the lengths of the two opposing edges are different, such that at least two slots defined between the at least two tines have different lengths.

2. The socket electrical contact of claim 1, wherein each tine contains a blunt tip.

3. The socket electrical contact of claim 1, wherein the base contains a seam.

4. The socket electrical contact of claim 3, wherein, on each tine, the shorter edge is closer to the seam than the longer edge.

5. The socket electrical contact of claim 1, wherein the body contains a central longitudinal axis and the tines deflect toward the central longitudinal axis as they extend from the body.

6. The socket electrical contact of claim 1, wherein the body has a tubular shape.

7. The socket electrical contact of claim 6, wherein the tubular shape has an elliptical, circular, triangular, square, square, pentagonal, hexagonal, or octagonal cross-section.

8. The socket electrical contact of claim 1, wherein the shorter edge is about 5-12% of the longer edge.

9. An electrical assembly comprising
a. a socket electrical contact of claim 1; and
b. a pin contact inserted between the at least two tines.

10. The electrical assembly of claim 9, wherein each tine contains a blunt tip.

11. The electrical assembly of claim 9, wherein the base contains a seam.

12. The electrical assembly of claim 11, wherein, on each tine, the shorter edge is closer to the seam than the longer edge.

13. The electrical assembly of claim 9, wherein the body contains a central longitudinal axis and the tines deflect toward the central longitudinal axis as they extend from the body.

14. The electrical assembly of claim 9, wherein the body has a tubular shape.

15. The electrical assembly of claim 14, wherein the tubular shape has an elliptical, circular, triangular, square, square, pentagonal, hexagonal, or octagonal cross-section.

16. The electrical assembly of claim 9, wherein the shorter edge is about 5-12% of the longer edge.

17. A method for making a socket electrical contact comprising the steps of a. cutting a flat sheet of conductor into a blank; and b. forming the blank into a socket electrical contact containing i. a base; and ii. at least two tines extending from the base, each tine containing two opposing edges, a contact surface, and an exterior surface, and each of the edges of each tine defining a length from the base to a tip of each tine, respectively, wherein the lengths of the two opposing edges are different, such that at least two slots defined between the at least two tines have different lengths.

18. The method of claim 17, wherein each tine contains a blunt tip.

19. The method of claim 17, wherein the forming process reveals a seam in the base.

20. The method of claim 17, wherein, on each tine, the shorter edge is closer to the seam than the longer edge.

* * * * *